US010947987B2

(12) United States Patent
Gill et al.

(10) Patent No.: US 10,947,987 B2
(45) Date of Patent: Mar. 16, 2021

(54) HIGH SPEED CENTRIFUGAL PUMP LINED SEAL HOUSING

(71) Applicant: Sundyne, LLC, Arvada, CO (US)

(72) Inventors: David R. Gill, Littleton, CO (US); Ryan Grimm, Denver, CO (US); Jared Wageman, Centennial, CO (US)

(73) Assignee: Sundyne, LLC, Arvada, CO (US)

( * ) Notice: Subject to any disclaimer, the term of this patent is extended or adjusted under 35 U.S.C. 154(b) by 349 days.

(21) Appl. No.: 15/094,481

(22) Filed: Apr. 8, 2016

(65) Prior Publication Data

US 2017/0292527 A1 Oct. 12, 2017

(51) Int. Cl.

| | |
|---|---|
| ***F04D 29/12*** | (2006.01) |
| ***F04D 1/00*** | (2006.01) |
| ***F04D 29/02*** | (2006.01) |
| ***F04D 29/22*** | (2006.01) |
| ***F04D 29/06*** | (2006.01) |
| ***F04D 29/10*** | (2006.01) |

(52) U.S. Cl.

CPC ..... *F04D 29/126* (2013.01); *F04D 1/00* (2013.01); *F04D 29/026* (2013.01); *F04D 29/061* (2013.01); *F04D 29/22* (2013.01); *F05B 2230/60* (2013.01); *F05B 2240/20* (2013.01); *F05B 2240/57* (2013.01); *F05B 2280/1071* (2013.01); *F05B 2280/4005* (2013.01); *F05B 2280/4007* (2013.01)

(58) Field of Classification Search

CPC ..... F04D 29/126; F04D 1/00; F04D 29/026; F04D 29/061; F04D 29/22; F05B 2230/60; F05B 2240/20; F05B 2240/57; F05B 2280/1071; F05B 2280/4005; F05B 2280/4007

See application file for complete search history.

(56) References Cited

U.S. PATENT DOCUMENTS

| | | | | |
|---|---|---|---|---|
| 3,551,067 A * | 12/1970 | Wissman | F04D 7/02 | 415/134 |
| 4,533,294 A * | 8/1985 | Onal | F04D 13/00 | 415/119 |
| 4,722,664 A * | 2/1988 | Wissman | F04D 29/026 | 415/197 |
| 6,371,488 B1 * | 4/2002 | Szymborski | F04D 29/126 | 277/358 |
| 7,770,897 B2 * | 8/2010 | Berdichevsky | F16J 15/322 | 277/551 |

(Continued)

*Primary Examiner* — Michael Lebentritt
*Assistant Examiner* — Eric J Zamora Alvarez
(74) *Attorney, Agent, or Firm* — Frost Brown Todd LLC

(57) ABSTRACT

A centrifugal pump, and components thereof, operable at high speeds, is described under the present disclosure. A hard polymer sleeve can be applied to certain surfaces of a seal casing within the pump. If the sleeve is applied along surfaces near the center shaft, then the hard polymer will withstand the forces and pressures of the system. The hard polymer might not be used along the outer diameter, farther from the shaft, because velocities are higher the further out one goes. The current disclosure allows for the use of fluoropolymer in the lining sleeve. The benefits of fluoropolymer have been unavailable in high speed centrifugal pumps because the forces are too great on the periphery of the seal casing. However, the lower speeds along the interior, near the shaft, allow fluoropolymer to be used.

18 Claims, 4 Drawing Sheets

(56) References Cited

U.S. PATENT DOCUMENTS

| | | | | |
|---|---|---|---|---|
| 8,083,235 | B2 * | 12/2011 | Azibert | F16J 15/54 277/349 |
| 9,897,102 | B2 * | 2/2018 | Wang | F04D 7/06 |
| 2004/0156711 | A1 * | 8/2004 | Quinn | F04D 29/126 415/170.1 |
| 2013/0115053 | A1 * | 5/2013 | Chien | F04D 29/0473 415/122.1 |
| 2015/0326094 | A1 * | 11/2015 | Cunningham | E21B 41/0007 310/87 |
| 2015/0345265 | A1 * | 12/2015 | Cunningham | F04D 13/083 415/1 |

* cited by examiner

HIGH SPEED CENTRIFUGAL PUMP LINED SEAL HOUSING

TECHNICAL FIELD

The present disclosure is directed to high speed centrifugal pumps and more particularly to a lined space behind the pump impeller and seal housing.

BACKGROUND OF THE INVENTION

Centrifugal pumps are common for transporting fluids. Centrifugal pumps help convert rotational kinetic energy into hydrodynamic energy, helping move fluid from one place to another. Commonly, a centrifugal pump uses an impeller, which spins rotationally and is connected to a fluid source. The impeller often resembles a disc with a series of blades or extensions, or a disc with channels on one side. The impeller spins, causing a pressure differential. This pressure differential pulls fluid into the housing. The impeller will direct the fluid into a second channel or pipe for transport to another location.

Current designs of high speed centrifugal pumps typically utilize metallic components for stationary surfaces. Behind the impeller there can be a seal housing. The seal housing contains the seals that seal the shaft and prevent pumped fluid from entering the gears, and other parts of the machinery. One problem with current solutions is that sticky or gritty pumped fluids can get stuck at various parts of the machinery, in particular in the seal chamber causing pump failure. At the same time, if the pump is transporting water, it can be very important to prevent the pumped fluid from penetrating into the seal chamber and causing fouling. One solution for preventing build up has been to use polymer-based linings, or rubber. But these solutions have been limited to low speed pumps, e.g. below 3600 rpm.

BRIEF SUMMARY OF THE INVENTION

One embodiment of the present disclosure comprises a centrifugal fluid pump comprising: an impeller operable, when spun rotationally, to cause a pressure differential and pull fluid from an inlet and direct the fluid toward an outlet; a shaft operable to move the impeller rotationally; a seal casing operable to fit around the shaft; a cover operable to fit around the shaft and on a side of the seal casing proximate the impeller; a seal operable to fit around the shaft and on a side of the seal casing distal the impeller; and a lining attached to a surface of the seal casing that faces the shaft, wherein the lining comprises a hard polymer and is to isolate and protect the seal chamber.

Another embodiment comprises a pump casing for a centrifugal fluid pump comprising: an annular opening operable to receive a shaft therein and to allow the pump casing to fit along the shaft and proximate an impeller; and a polymer lining operable to attach to an inner surface of the annular opening facing the shaft, wherein the sleeve comprises a hard polymer and is capable of isolating the annular opening; wherein the annular opening is configured to create a seal chamber comprising the space between the inner surface and the shaft.

Another embodiment comprises a method of constructing a centrifugal pump comprising: providing an impeller operable, when spun rotationally, to cause a pressure differential and pull fluid from an inlet and toward an outlet; providing a shaft operable to move the impeller rotationally; providing a seal casing operable to fit around the shaft; providing a cover operable to fit around the shaft and on a side of the seal casing proximate the impeller; providing a seal operable to fit around the shaft and on a side of the seal casing distal the impeller; and attaching a lining to a surface of the seal casing that faces the shaft, wherein the lining comprises a hard polymer.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
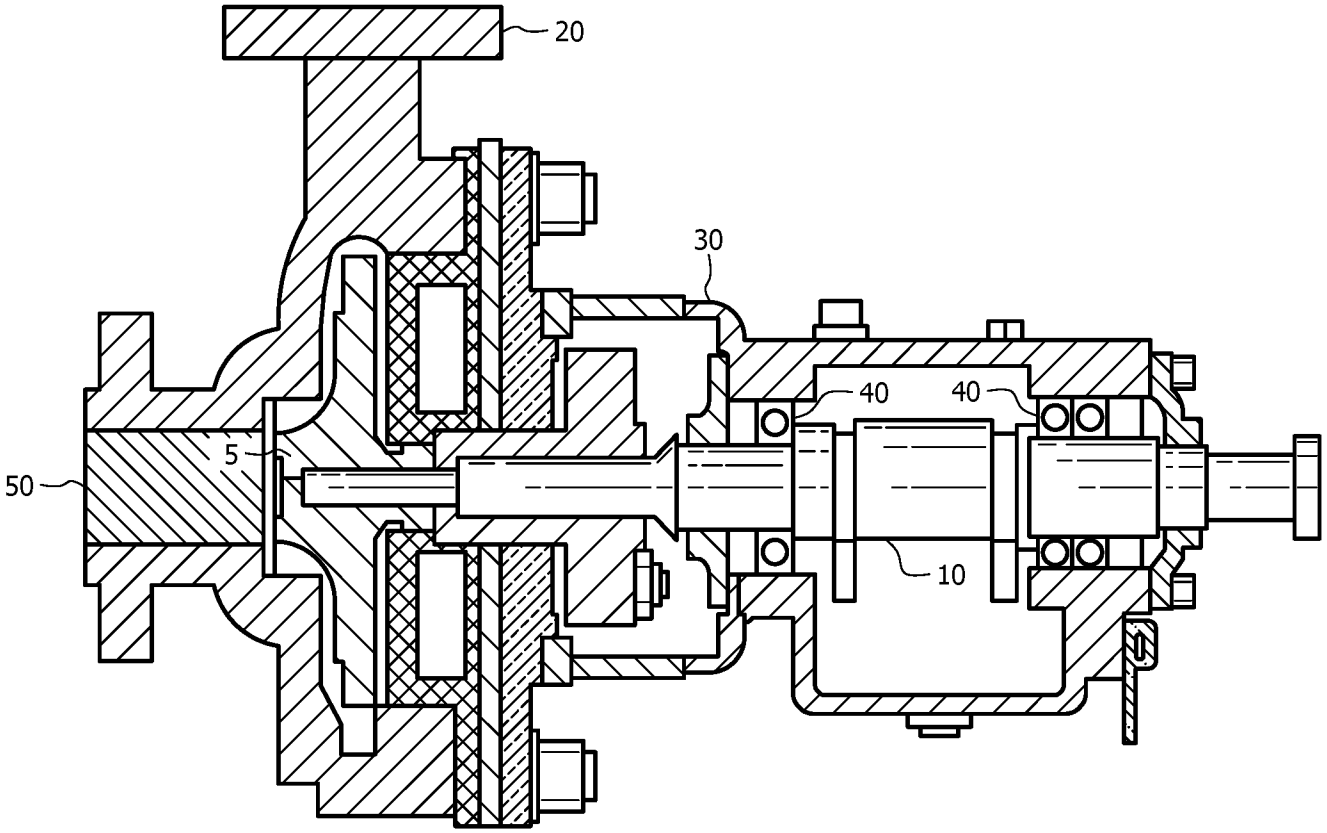
FIG. 1 (Prior Art)
FIG. 1 is a diagram of an embodiment of a centrifugal pump.

Referring now to FIG. 1, an embodiment of a centrifugal pump is shown. Impeller 5 spins rotationally, creating a pressure differential. Fluid is pulled in through inlet 50, is spun by the impeller, and exits through outlet 20 to further piping or hoses. Shaft 10 turns the impeller, and can be turned by a motor or power source of some kind (not shown). Casing 30 houses parts of the pump. Bearings 40 assist in the spinning and position of the shaft and other components. In the prior art, pumped fluid is located on back side of the impeller 5 (distal to the inlet 50) and surrounding the shaft 10. Pumped fluid can also be located in casing 30, around bearings 40, and some other areas around the shaft. The pumped fluid will usually cover the entire diameter of the impeller.

Figure 2:
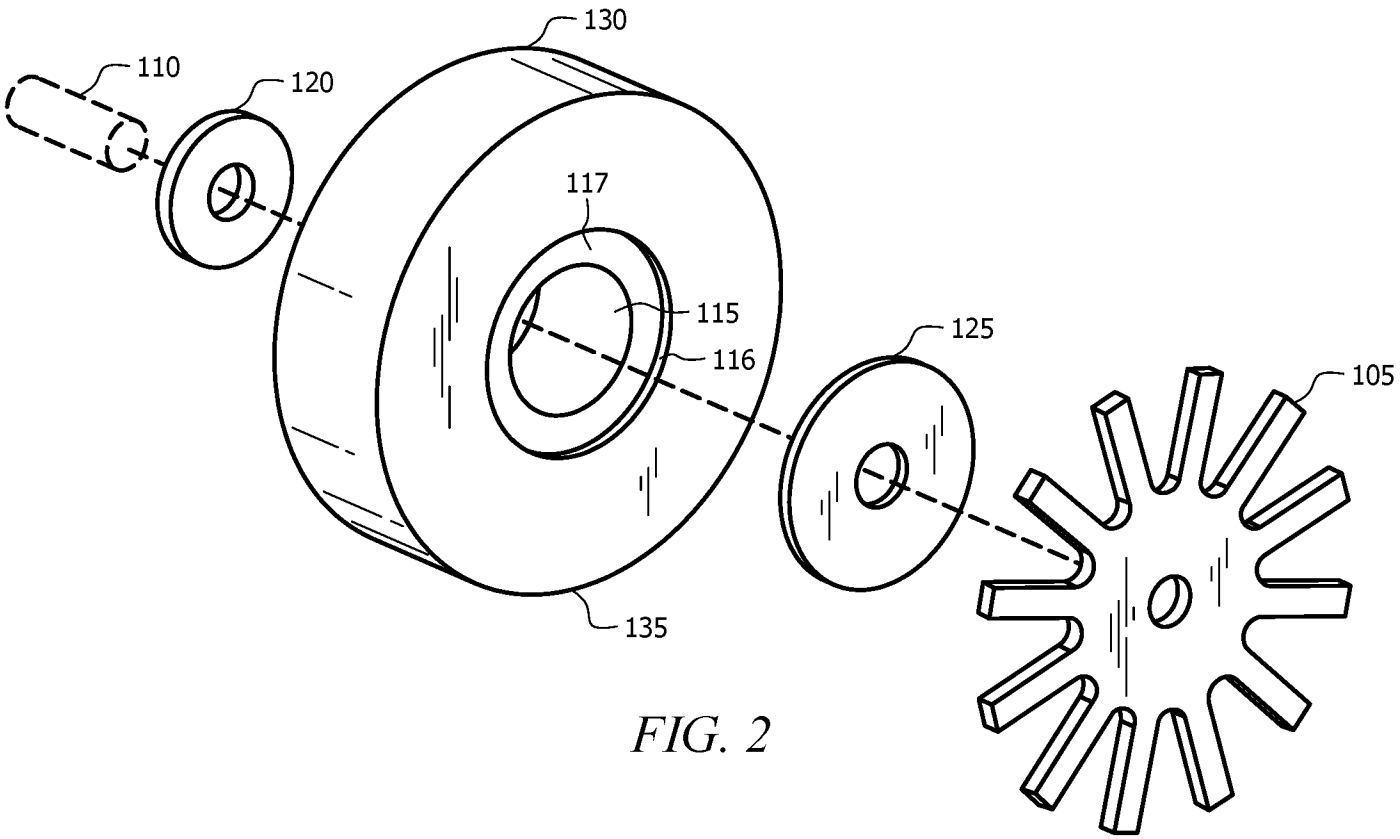
FIG. 2 is a diagram of an embodiment of portions of a centrifugal pump.

FIG. 2 shows an exploded view of embodiments of several components. Impeller 105, cover 125, seal housing 130, and seal 120 sit on shaft 110. Shaft 110, powered by a motor or power supply (not shown) turns impeller 105 to assist in displacing water or other process fluid by forcing the fluid from the inlet and discharging it out of the outlet. Surfaces 115, 116, 117 are faces of the seal housing 130 and face other components, such as cover 125 and shaft 110. In the prior art, surfaces 115, 116, 117 are typically constructed of metal and contact pumped fluid.

Embodiments of pumps incorporating the concepts described herein use hard polymers instead of metallic parts on certain components in high speed pumps. For example, when the components of FIG. 2 are assembled, impeller 105 will spin with shaft 110. Housing 130 will be stationary. Impeller 105 will spin with shaft 110 at a given angular velocity. The impeller's 105 absolute velocity will be higher at outer rim area 135 than at surfaces 115, 116, 117. The high absolute velocity of impeller 105 at area 135 prevents the use of hard polymers. However, lining, molding or sleeking surfaces such as 115, 116, 117 with a hard polymer can be achieved. Hard polymers can be avoided at area 135, but can still be applied at surfaces closer to the shaft.

Figure 3:
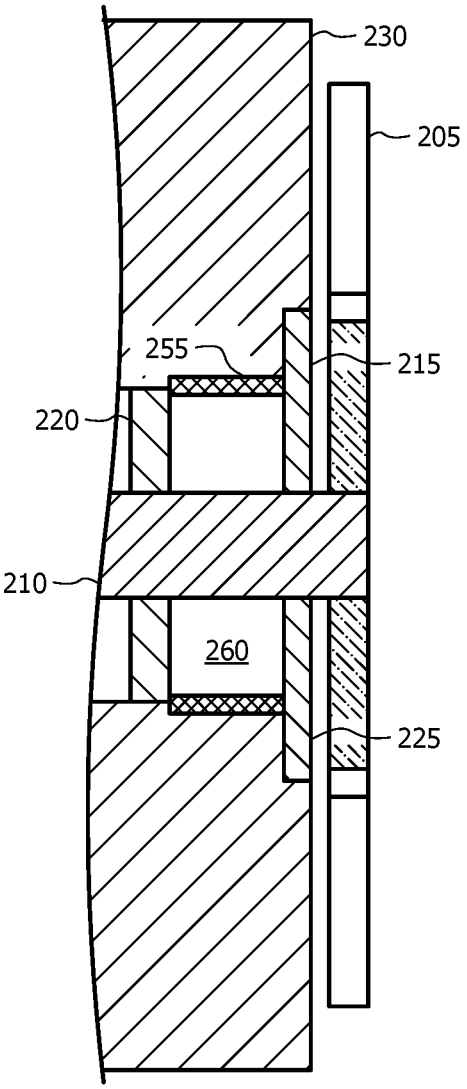
FIG. 3 is a diagram of an embodiment of portions of a centrifugal pump under the present disclosure.

FIG. 3 shows an embodiment using the present disclosure. FIG. 3 is similar to FIG. 2, except that the components are shown joined together. Shaft 210 passes through the center of seal 220, cover 225, seal housing 230, and passes through or is attached to impeller 205 so as to turn the impeller 205. In this embodiment, interior surface 215 of seal housing 230 is covered with a hard polymer lining sleeve 255. The space behind the cover 225 containing the lining sleeve 255 and the shaft 210 comprises the seal chamber 260. In this embodiment, a hard polymer, such as fluoropolymer, is placed only on surface 215, and not on more exterior portions of the seal housing or other components. Lining sleeve 255 will prevent the entering, settling, or sticking of materials to the walls of the seal chamber 260.

Figure 4:
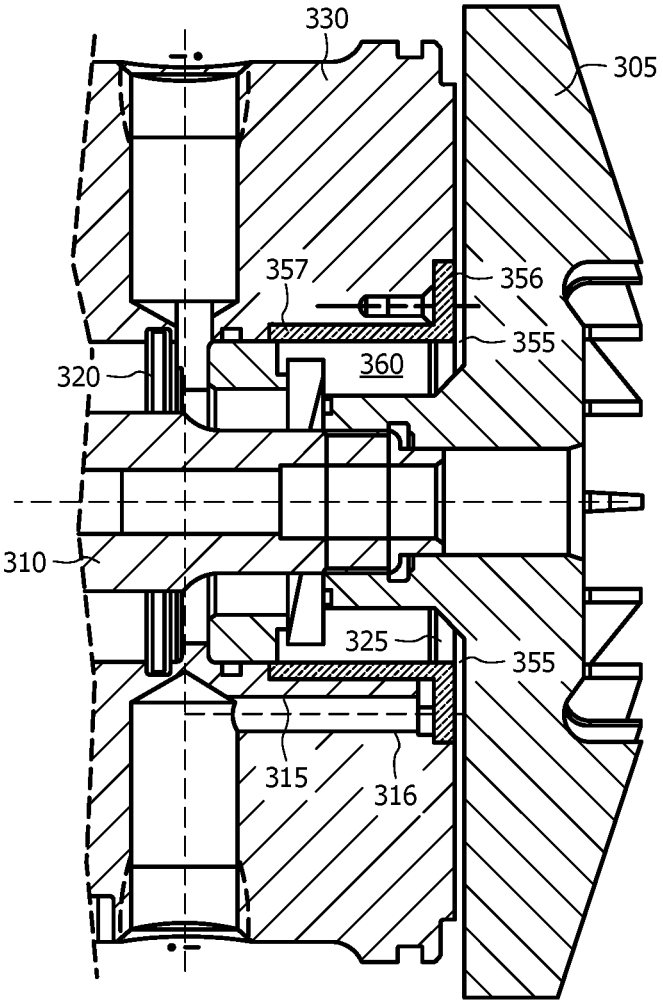
FIG. 4 is a diagram of an embodiment of portions of a centrifugal pump under the present disclosure.

FIG. 4 displays another embodiment of the present disclosure. Shaft 310 extends through seal 320, seal housing 330, cover 325 and impeller 305. FIG. 4 shows a different impeller embodiment. Various impeller geometries, shapes, styles, and dimensions are compatible with the current disclosure. Lining sleeve 355 lines the interior of seal housing 330 along edges 315, 316. Lining sleeve 355 comprises a sleeve portion 357 and a plate portion 356. Other embodiments can comprise solely a sleeve portion 357 or a plate portion 356. The embodiment of FIG. 4 comprises both portions. Other areas between impeller 305 and seal housing 330, or seal chamber 360, or other areas, will see pumped fluid which may contain solids or lubricants. However, as the present disclosure teaches, the use of a hard polymer, such as Teflon, in a lining sleeve such as 355, will provide a smooth and lubricated surface to prevent settling or sticking of process fluids.

The present teachings allow for operation in pumps at greater than 5,000 rpm. Using the present teachings to apply fluoropolymer, or another appropriate solid polymer, to interior portions of a pump, will generally be limited to portions near the center, e.g. near the shaft. The further out from the shaft that fluoropolymer is applied, the greater stresses will act on the fluoropolymer. Fluoropolymer can deform at high pressures and speeds. But near the shaft the fluoropolymer will remain undeformed and provide appropriate non-stick surface. Fluoropolymer will generally not be able to be applied to all the wetted components. Though at slower speeds, fluoropolymer cover 225 can be increased in diameter from the shaft.

The embodiments described use fluoropolymer (polytetrafluoroethylene) for the lining sleeve. While the preferred embodiment uses fluoropolymer, other embodiments may use other thermoplastic polymers with appropriate properties. Some embodiments may use fluoropolymer that is cross-linked or otherwise combined with other materials or substances. Fluoropolymer can refer to polytetrafluoroethylene (PTFE) or other polymers such as perfluoroalkoxy (PFA) or fluorinated ethylene propylene (FEP).

Seal housings or other components of fluid pumps are often manufactured with materials such as 316 stainless steel. Fluoropolymer can be applied to steel according to methods well known in the art. Materials besides stainless steel are possible for use in pump and pump components. Materials besides fluoropolymer may be useable for lining the interior of the seal casing according to the present teachings.

Figure 5:
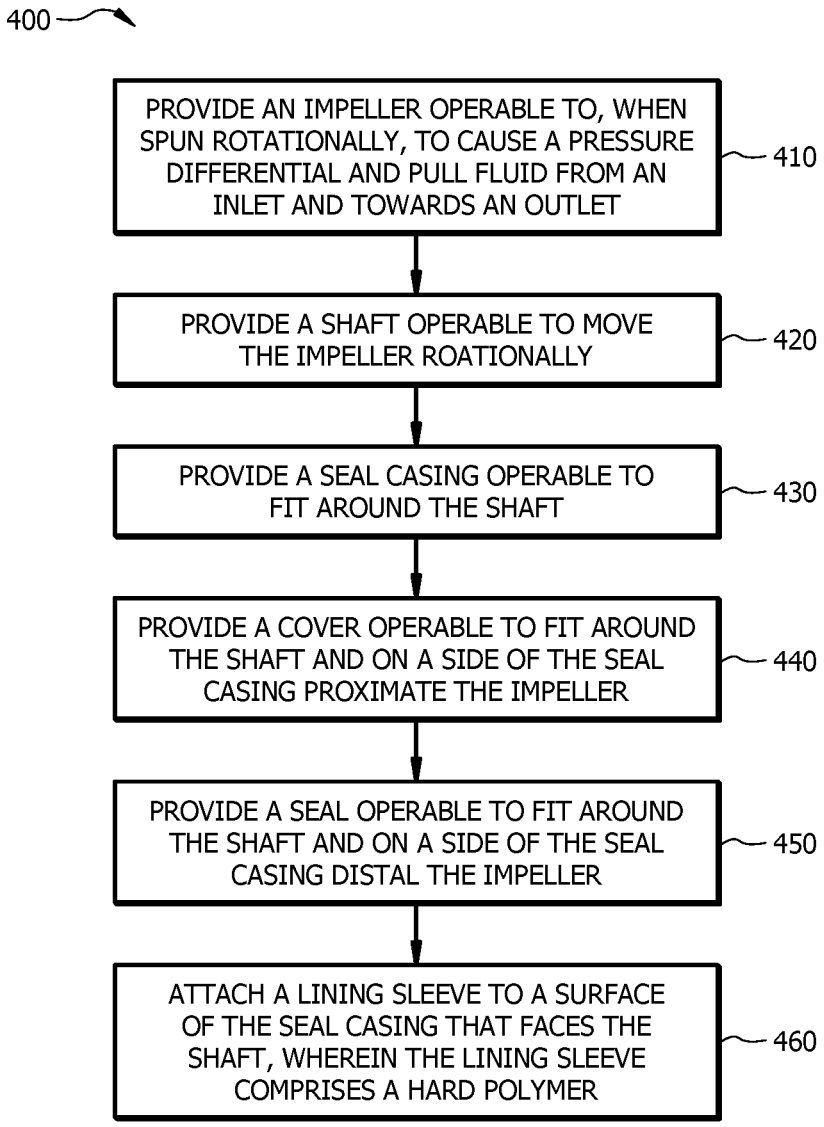
FIG. 5 is a flow chart diagram of a process embodiment under the present teachings.

FIG. 5 displays a method embodiment 400 of the present teachings. Step 410 provides an impeller operable, when spun rotationally, to cause a pressure differential and pull fluid from an inlet and toward an outlet. Step 420 provides a shaft operable to move the impeller rotationally. Step 430 provides a seal casing operable to fit around the shaft. Step 440 provides a cover operable to fit around the shaft and on a side of the seal casing proximate the impeller. Step 450 provides a seal operable to fit around the shaft and on a side of the seal casing distal the impeller. Step 460 attaches a lining sleeve to a surface of the seal casing that faces the shaft, wherein the lining sleeve comprises a hard polymer.

The embodiments of the teachings of the present disclosure have been illustrated with certain geometries. However, the current teachings can be implemented with various shapes of pumps, various impeller shapes, and across a variety of pump materials, sizes and geometries. Embodiments can include different types of pumps, including gas powered, electric powered, magnetic drive, or other types. In addition, the exact length and dimension of the lining sleeve (sleeve portion and plate portion) may differ according to the embodiment. In some embodiments, the plate portion will extend further out from the shaft, depending on the composition of the pumped fluid, speed or other characteristics of the given pump. The sleeve portion of the lining sleeve preferably covers an entire inner surface of the seal casing, however other geometries are possible. Some embodiments will comprise only a sleeve portion, or only a plate portion, as needed.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A centrifugal fluid pump comprising:

an impeller operable, when spun rotationally, to cause a pressure differential and pull fluid from an inlet and direct the fluid toward an outlet;

a shaft operable to move the impeller rotationally;

a seal housing operable to fit around the shaft;

a cover operable to fit around the shaft and on a side of the seal housing proximate the impeller, wherein the cover has a cover diameter less than a diameter of the impeller;

a seal operable to fit around the shaft and on a side of the seal casing housing distal the impeller; and a lining sleeve lining an inner surface of the seal housing between the cover and the seal that faces the shaft, wherein the lining sleeve comprises a hard polymer and is operable to lubricate the surface, wherein the cover is between the lining sleeve and the impeller.

2. The centrifugal pump of claim 1 wherein the lining sleeve comprises fluoropolymer.

3. The centrifugal pump of claim 1 wherein the lining sleeve covers a portion of the seal housing facing the cover.

4. The centrifugal pump of claim 1 wherein the seal housing comprises metal.

5. The centrifugal pump of claim 1 wherein the shaft is driven by a power source.

6. The centrifugal pump of claim 1 wherein the shaft is connected to a motor.

7. The centrifugal pump of claim 1 wherein the impeller rotates at least at 5,000 rpm.

8. The centrifugal pump of claim 1, wherein the lining sleeve is operable to prevent material from sticking to the inner surface of the seal housing.

9. A seal housing for a centrifugal fluid pump comprising:

an annular opening operable to receive a shaft therein and to allow the seal housing to fit along the shaft and proximate an impeller;

a seal chamber comprising a space between an inner surface of the annular opening and the shaft, wherein the seal chamber is configured to receive pumped fluid;

a lining sleeve lining the inner surface of the annular opening facing the shaft in the seal chamber, wherein the lining sleeve comprises a hard polymer and is operable to prevent the pumped fluid from sticking to the inner surface of the annular opening; and a cover operable to fit around the shaft and recessed into the seal housing, wherein the lining sleeve covers a portion of the seal housing facing the cover, the cover disposed between the lining sleeve and impeller, wherein the impeller is able to spin relative to the cover, and wherein the cover has a cover diameter less than a diameter of the impeller.

10. The seal housing of claim 9 wherein the lining sleeve comprises fluoropolymer.

11. The seal housing of claim 9 wherein the pump casing comprises stainless steel.

12. The seal housing of claim 9 wherein the shaft is driven by a power source.

13. The seal housing of claim 9 wherein the shaft is connected to a motor.

14. The seal housing of claim 9 wherein the impeller rotates at least at 5,000 rpm.

15. A method of constructing a centrifugal pump comprising:

providing an impeller operable, when spun rotationally, to cause a pressure differential and pull fluid from an inlet and toward an outlet;

providing a shaft operable to move the impeller rotationally;

providing a seal housing operable to fit around the shaft;

providing a cover operable to fit around the shaft and on a side of the seal housing proximate the impeller, wherein the cover has a cover diameter less than a diameter of the impeller;

providing a seal operable to fit around the shaft and on a side of the seal casing housing distal the impeller; and lining an inner surface of the seal housing with a lining sleeve between the cover and the seal that faces the shaft, wherein the lining sleeve comprises a hard polymer, wherein the cover is between the lining sleeve and the impeller.

16. The method of claim 15 wherein the lining sleeve comprises fluoropolymer.

17. The method of claim 15 wherein the lining sleeve comprises a thermoplastic polymer.

18. The method of claim 15 wherein the cover is recessed into the seal housing and covers a portion of the seal housing facing the impeller.

* * * * *